US011564049B2

(12) United States Patent
Tossing et al.

(10) Patent No.: US 11,564,049 B2
(45) Date of Patent: Jan. 24, 2023

(54) MULTI-CHANNEL MICROPHONE RECEIVER WITH MIXED CHANNEL

(71) Applicant: Sennheiser electronic GmbH & Co. KG, Wedemark (DE)

(72) Inventors: Kai Tossing, Hannover (DE); Sven Hampel, Isernhagen (DE); Jean-Christophe Detay, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 17/172,320

(22) Filed: Feb. 10, 2021

(65) Prior Publication Data

US 2021/0250712 A1 Aug. 12, 2021

(30) Foreign Application Priority Data

Feb. 11, 2020 (DE) ..... 102020103389.3

(51) Int. Cl.
*H04R 27/00* (2006.01)

(52) U.S. Cl.
CPC ..... *H04R 27/00* (2013.01); *H04R 2227/003* (2013.01)

(58) Field of Classification Search
CPC . H04R 27/00; H04R 29/007; H04R 2227/003
USPC ..... 381/77, 79–82, 91–92, 111, 113–114
See application file for complete search history.

(56) References Cited

U.S. PATENT DOCUMENTS

| | | | | |
|---|---|---|---|---|
| 9,621,224 | B2 * | 4/2017 | Babarskas | H04B 3/542 |
| 11,006,234 | B2 * | 5/2021 | Matthias | H04S 3/008 |
| 2012/0314890 | A1 * | 12/2012 | El-Hoiydi | H04R 25/558 381/315 |
| 2013/0251173 | A1 * | 9/2013 | Ejima | H04R 1/08 381/77 |
| 2014/0093103 | A1 * | 4/2014 | Breece, III | H03F 3/68 381/120 |

(Continued)

FOREIGN PATENT DOCUMENTS

| | | |
|---|---|---|
| DE | 10 2018 128 214 | 5/2020 |
| DE | 102018128214 | 5/2020 |
| WO | WO 2007/052269 | 5/2007 |

OTHER PUBLICATIONS

German Search Report for Application No. DE 10 2020 103 389.3 dated Jul. 15, 2021.

*Primary Examiner* — Disler Paul
(74) *Attorney, Agent, or Firm* — Haug Partners LLP

(57) ABSTRACT

A multi-channel microphone receiver (MCR) for two or more wireless microphones ($M_1, \ldots, M_N$) comprises a network interface and at least one mixer (MX) adapted for mixing audio signals ($D_1, \ldots, D_N$) of the microphones. The mixer may be configured without any reconfiguration of the actual network being required. In addition to the single audio channels, the audio signal mixed according to the configuration may be output via a separate audio output channel ($DO_{Mx}$, $AO_{Mx}$), which may be analog or digital.

10 Claims, 2 Drawing Sheets

(56) References Cited

U.S. PATENT DOCUMENTS

2018/0014118 A1* 1/2018 Kung ..... H04H 60/04
2019/0166423 A1* 5/2019 Anderson ..... H04B 17/309

* cited by examiner

MULTI-CHANNEL MICROPHONE RECEIVER WITH MIXED CHANNEL

CROSS REFERENCE TO RELATED APPLICATION(S)

This application claims the benefit of the foreign priority of German Patent Application No. 10 2020 103 389.3, filed on Feb. 11, 2020, the entirety of which is incorporated herein by reference.

FIELD OF DISCLOSURE

The invention relates to a device for receiving multiple radio signals, in particular microphone signals that comprise audio data.

BACKGROUND

Wireless microphone receiving systems receive usually from a wireless microphone a radio signal modulated with an audio signal, which they demodulate so as to regain the audio signal. This audio signal is then provided for example to a sound system, also known as PA (Public Address) system, or to any other device for audio reproduction or audio processing.

However, often several wireless microphones are required simultaneously. For this case, wireless microphone receiving systems are known that provide separate radio links for a plurality of microphones. Usually, each wireless microphone uses an individual radio channel, so that these wireless microphone receiving systems are designed as multi-channel receivers. The multi-channel receivers output the audio signals of the various microphones separately from each other on separate channels. The audio signals can be combined with each other by mixing in a separate mixing console. Both for single-channel receivers and multi-channel receivers, the output signals can be provided via a network interface to a network.

Extensive systems in larger buildings, for example in conference centers or in lecture halls of universities, often use a network with a central control point for audio transmission. The audio signals of any particular room that were mixed in a separate mixing console are then routed back via the network and the central control point to the respective room, and potentially to other rooms, in order to be reproduced there through loudspeakers of a PA system. The network is also used for feeding the audio signals to be mixed to the mixing console. The audio signals may also be transmitted as radio signals directly to the audience, who may receive and replay them with appropriate receivers. For example, DE102018128214A1 discloses a method and a device for selecting an audio data stream by means of a smartphone, where a radio signal comprises a plurality of audio data streams. The smartphone detects one of the audio data streams as corresponding to the ambience sound and selects this audio data stream for playback.

Such extensive systems may be improved by further functions that increase their flexibility. For example, especially in the case of multi-channel microphone receivers, configuration options are limited, especially for a user located in the respective room. Moreover, a reduction of data traffic would be desirable to relieve the network.

SUMMARY OF THE INVENTION

An object of the present invention is to provide improved configuration options to a user of a multi-channel microphone receiver. Another object is to reduce the network load. At least these objects are achieved by a multi-channel microphone receiver as disclosed herein.

According to the present invention, a multi-channel microphone receiver comprises a network interface and a mixer, which may be configured locally, i.e. at the location where the receiver is, without requiring reconfiguration of the actual network. The mixer may mix the audio signals of the various microphones according to a local configuration. The audio signal mixed according to the local configuration can be output via a separate output channel, in addition to the single audio channels. The output may be digital and/or analog.

BRIEF DESCRIPTION OF THE DRAWINGS

Further advantageous embodiments are disclosed in the dependent claims and the following description with reference to the drawings, which show in FIG. 1 shows an overview over a multi-channel receiving system, according to an embodiment;

DETAILED DESCRIPTION OF PREFERRED EMBODIMENTS

Figure 1:
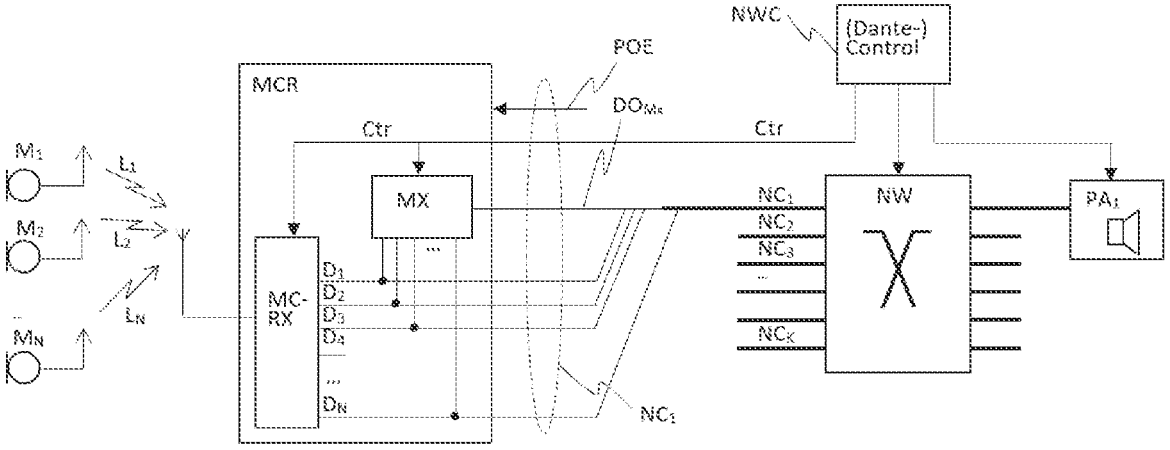

FIG. 1 shows an overview over a multi-channel receiving system with a multi-channel receiver MCR that is adapted for receiving the radio signals of a plurality of wireless microphones $M_1, M_2, \ldots, M_N$ via a plurality of radio channels $L_1, L_2, \ldots, L_N$. The multi-channel receiver MCR comprises at least a multi-channel receiving unit MC-RX and a mixer MX. The audio signals are output as separate digital signals or audio channels $D_1, D_2, \ldots, D_N$, respectively, via a network connection $NC_1$ into a digital network NW. The network connection $NC_1$ may be a single (network) cable or any other network connection. The network may be a LAN (Local Area Network), and in particular may be a digital audio network such as a Dante network, for example. It is controlled via a network control center or network control point NWC, which in the case of a Dante network is or comprises a so-called Dante controller. One or more audio playback devices $PA_1$ such as e.g. PA systems, loudspeakers, amplifiers etc. may be connected to the network NW in order to playback one or more of the network input signals $NC_1, NC_2, \ldots, NC_K$.

In some application scenarios, the multi-channel receiving system comprises a plurality of multi-channel receivers MCR that are located in different rooms, e.g. lecture halls, and that are each connected via radio links with a plurality of wireless microphones. An example is described below with reference to FIG. 5.

According to the invention, the problem of a potentially very high network load, or respectively a limitation of the number of audio channels transmittable in the network, may be resolved by combining a plurality of audio signals into a single audio signal or audio channel already in the multi-channel receiver MCR. A mixer MX that combines two or more audio signals $D_1, \ldots, D_N$ into a single audio signal may be used for this purpose. The resulting mixture signal may be fed to the network as an additional digital output channel $DO_{Mx}$ and may thus replace several of the corresponding audio channels $D_1, \ldots, D_N$. Since these no longer have to be transported individually by the network, the network load may be reduced.

As a further advantage, a separate mixing console which would be another separate network component and which thus would increase the network load and would complicate the network structure, especially in the case of several mixers, is no longer required. Instead, the users may select for each room separately whether or not mixing is desired and how to configure it. For this purpose, the user may access the mixer directly via local configuration data, without any need to modify e.g. the network configuration. The mixed audio signal is provided directly in the room, or at the multi-channel receiver respectively, for example as an analog or digital audio signal.

Another advantage is that, e.g. in a Dante network, the mixed audio signal may be configured without any need to modify Dante configuration parameters, which would conventionally be required. This is because configuration parameters for the mixer, which are comprised in the configuration data, are completely independent from network configuration parameters, according to an aspect of the invention. Also the balance can now be adjusted for each audio channel separately without having to modify Dante configuration parameters. Overall, this makes the system easier to handle.

A further advantage is that the complexity of the network switch NW that flexibly distributes the data streams in the network may be reduced. The reason is that, in one embodiment, not all input channels $D_1, \ldots, D_N$ need to be connected and routed separately anymore. Instead, several or all audio channels which may e.g. originate from a particular room can be bundled into a single audio channel by means of the mixer MX. In this manner, e.g. in a multi-channel receiver system for twenty rooms with up to four wireless microphones each, the network switch conventionally needs eighty inputs. But if e.g. in fifteen of the rooms only a single microphone is used simultaneously at any given time, according to experience, and only in five rooms several microphones are used, the network switch needs only 5×4+15=35 inputs. The assignment of the rooms to the inputs of the network switch NW is fully flexible and easy to configure.

Power supply of the multi-channel receiver MCR may be done conventionally via the network, e.g. based on power-over-Ethernet (PoE). Also at least a part of the configuration data or control data Ctr may be received via the network from the network control point NWC. Alternatively, the power supply may be done from other sources, for instance an external power supply unit.

Furthermore, at least a portion of the configuration data or control data Ctr may be received via a different interface, other than the network, for instance via a wireless connection such as Bluetooth or Near Field Communication (NFC) directly from a control unit that may be located in the room. This may be a wireless terminal, e.g. a smartphone. In one embodiment, the user may access the network control point NWC via a control software by means of a control device, or a smartphone respectively, and e.g. configure the mixer MX and/or other parts of the multi-channel receiver MCR. Individual audio channels $D_1, \ldots, D_N$ including the mixed channel $DO_{Mx}$ can also be switched on and off, or their gain can be adjusted, already in the multi-channel receiver MCR in this way (not shown in FIG. 1).

Figure 2:
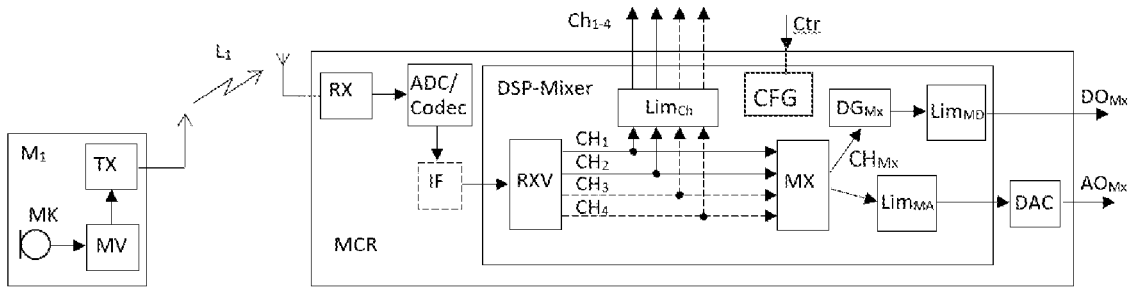
FIG. 2 shows a block diagram of a multi-channel receiver, according to an embodiment.

FIG. 2 shows a block diagram of a multi-channel receiver MCR, according to an embodiment. Although only a single radio link $L_1$ to a wireless microphone $M_1$ is exemplarily shown, two or more wireless microphones may be connected via separate radio links. In the depicted embodiment, up to four wireless microphones may be connected via separate radio links. Each wireless microphone $M_1$ comprises at least a microphone capsule MK, a microphone amplifier MV and a transmitter TX. The microphones' radio signals are received and demodulated by one or more radio receivers RX. The resulting audio signals are digitized in an analog-to-digital converter ADC, and optionally may be decoded and subjected to an interface IF processing, if required. The various audio signals, or audio channels respectively, $CH_1, \ldots, CH_4$ are extracted and amplified in an extraction and amplifying unit RXV. A first network output unit $Lim_{Ch}$ generates for each of the audio channels $CH_1, \ldots, CH_4$ a network signal corresponding to a network channel $Ch_1, \ldots, Ch_4$ for output into a network. Single audio channels may be switched on and off in the first network output unit $Lim_{Ch}$. In particular, the first network output unit $Lim_{Ch}$ may comprise a limiter per audio channel for limiting particularly high audio signal levels in any of the audio channels. The multi-channel receiver MCR is controlled via a control unit or configuration unit CFG, which may receive respective control or configuration data Ctr e.g. via the network.

Further, the multi-channel receiver MCR according to the invention comprises a mixer MX adapted for mixing the audio channels $CH_1, \ldots, CH_4$ in a flexible manner. The mixed audio signal $CH_{Mx}$ may be output as a digital signal $DO_{Mx}$ via a second network output unit $DG_{Mx}$ to the network and/or as an analog signal $AO_{Mx}$ via a digital-to-analog converter DAC to a loudspeaker or a PA system, in this exemplary embodiment. The second network output unit $DG_{Mx}$ and/or the mixer MX may comprise an amplifier with adjustable gain. The corresponding configuration data are also provided by the configuration unit CFG. Furthermore, this example comprises limiters $Lim_{MD}$, $Lim_{MA}$ for limiting the digital and/or analog mixed output signals. Optionally, the mixer MX or the respective network output unit may switch the output of the mixed output signals $DO_{Mx}$, $AO_{Mx}$ on and off.

As shown in FIG. 2, the extraction and amplifying unit RXV, the first network output unit Lima, the configuration unit CFG, the mixer unit MX, the second network output unit $DG_{Mx}$ and the limiters $Lim_{MD}$, $Lim_{MA}$ for the mixed output signals $DO_{Mx}$, $AO_{Mx}$ may be implemented by one or more processors, such as digital signal processors (DSP) and/or DSP mixers, which may be configured by suitable software programming.

Figure 3:
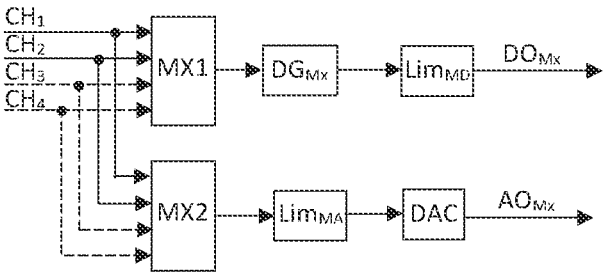
FIG. 3 shows a section from a block diagram of an embodiment with two separate mixers.

FIG. 3 shows as a portion of FIG. 2 an alternative variant with two separate mixers MX1, MX2, in an embodiment. In this case, the digital mixed output signal and the analog mixed output signal may have different parameters, for example different mixing ratios.

Figure 4:
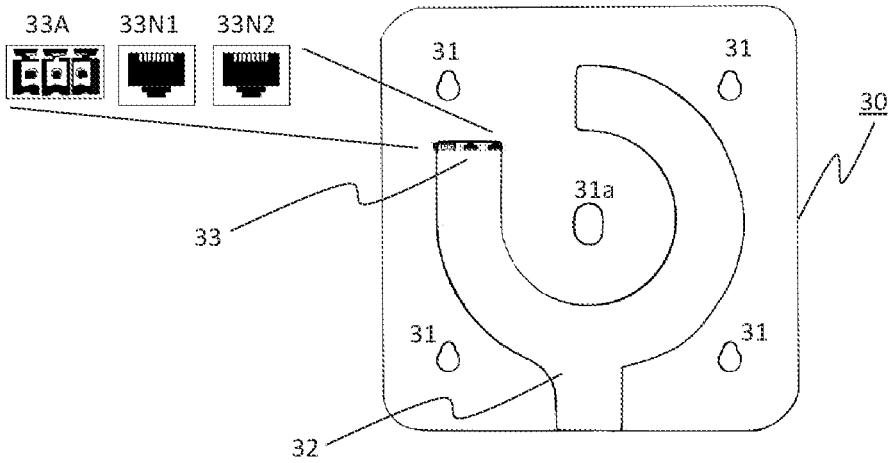
FIG. 4 shows an exemplary view of a multi-channel microphone receiver.

FIG. 4 shows, in one embodiment, an exemplary view of a rear side of a multi-channel receiver 30. A plurality of mounting holes 31,31*a* for wall mounting and a cable duct 32 for routing a cable are visible. Electrical connectors 33 are provided at one end of the cable duct 32. These connectors may comprise a connector 33A for output of the analog audio signal $AO_{Mx}$, e.g. a 3-pin socket, and two network connectors 33N1, 33N2, e.g. of the RJ45 type. One of the network connectors 33N1 may serve for power supply (e.g. using PoE) and for receiving configuration data Ctr. The digital audio channels may be output flexibly, depending on configuration, either also via the first network connector 33N1 or via a second network connector 33N2. Outputting the digital audio channels $D_1, \ldots, D_N, DO_{Mx}$ via the second network connector 33N2 has the advantage that two separate networks may be used for control data and audio data, wherein for the control data network a fluctuating and relatively long delay may be acceptable. Thus, e.g. conventional LAN or Ethernet may be used for this purpose. The audio data network, on the other hand, should preferably have a constant and low delay. In one embodiment, the single audio channels $Ch_1, \ldots, Ch_4$ may be output via one of the network connectors and the mixed audio signal $DO_{Mx}$ may be output via the other network connector.

In an embodiment, the user may access a control software via his or her smartphone, using e.g. an app, in order to perform configuration of the multi-channel receiver MCR. In this case, a further advantage of the invention is that the user who is directly at the receiver or in the respective playback room has a possibility to configure the multi-channel receiver, and in particular the mixer, without having to take care of any other network parameters and without having to access or go to the network control center.

As mentioned above, the invention is advantageous, among others, in application scenarios where the multi-channel receiving system comprises a plurality of multi-channel receivers MCR that are located in different rooms, e.g. lecture halls, and that are each connected via radio links with one or more wireless microphones. Further, in each of the rooms, and potentially also in additional further rooms, there are one or more loudspeakers which are configured to replay audio streams provided by the various multi-channel receivers MCR and transmitted through the network NW. In an embodiment, the multi-channel receiving system may be configured via the network control point NWC such that not only in each room the microphone signals of the microphones located in the respective room are replayed, but it is also possible to replay in each of the further rooms each of the audio channels. Likewise, additional microphones that are also connected to the network NW may be positioned in the further rooms. In this way, the additional rooms may be used as a spatial extension of the other rooms, e.g. lecture halls.

Figure 5:
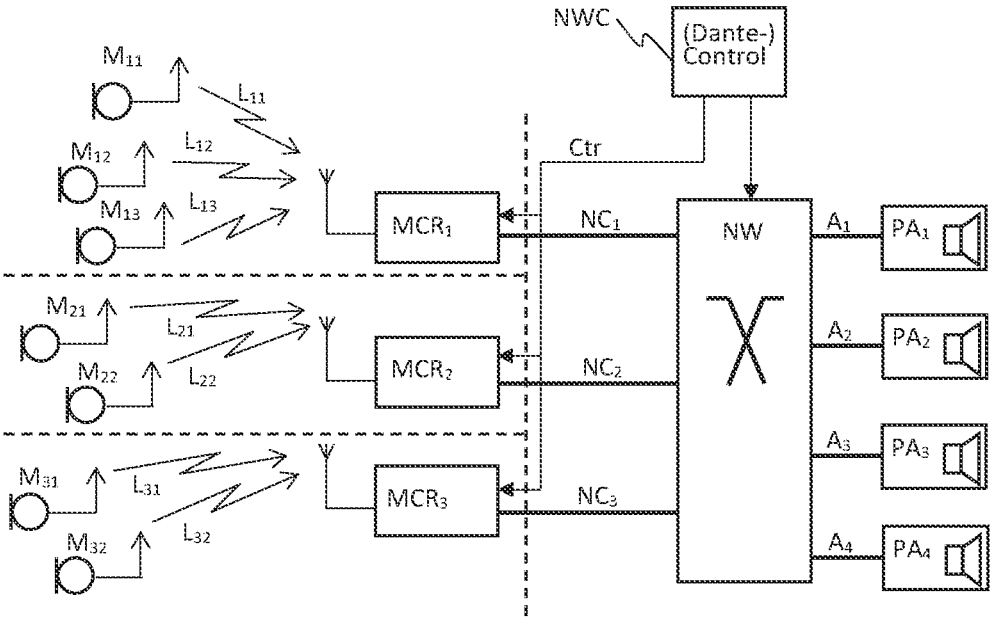
FIG. 5 shows an overview over a multi-channel receiving system, according to a further embodiment.

An example is shown in FIG. 5. A first multi-channel receiver $MCR_1$ and three wireless microphones $M_{11}$-$M_{13}$ connected to it through radio links $L_{11}$-$L_{13}$ are located in a first room. A second multi-channel receiver $MCR_2$ and two wireless microphones $M_{21}$,$M_{22}$ connected to it through radio links $L_{21}$,$L_{22}$ are located in a second room, and a third multi-channel receiver $MCR_3$ and two wireless microphones $M_{31}$,$M_{32}$ connected to it through radio links $L_{31}$,$L_{32}$ are located in a third room. All multi-channel receivers are connected via respective network connections $NC_1$,$NC_2$, $NC_3$ to the network NW, e.g. Dante network. The network NW switches the output signals of each multi-channel receiver, according to control and configuration information from the network control point NWC, to sound reproducing equipment $PA_1$-$PA_4$, such as loudspeakers. For example, a first, a second and a third loudspeaker $PA_1$-$PA_3$ may be located in the first, the second and the third room, respectively, and may be fed the corresponding audio channel to reproduce the respective sound. A fourth loudspeaker $PA_4$ may be located in a different fourth room and may flexibly be switched to reproduce sound of either of the first, second or third rooms. In each of the first, second and third rooms, a respective local user may configure the mixer of the respective multi-channel receiver according to individual preference, without having access to Dante network parameters. Each multi-channel receiver outputs at least a mixed audio signal via its network connection $NC_1$-$NC_3$. Thus, although seven wireless microphones are connected, only three audio signals $NC_1$-$NC_3$ need to be switched in the network NW, in a minimum configuration.

In an embodiment, a multi-channel microphone receiver MCR comprises at least one wireless receiver RX for wirelessly receiving radio signals $L_1, L_2, \ldots, L_N$ from two or more wireless microphones $M_1, M_2, \ldots, M_N$, an audio signal extraction unit ADC/Codec, RXV and a first network output unit $Lim_{Ch}$. The audio signal extraction unit ADC/Codec, RXV is adapted for extracting from the radio signals received from the two or more wireless microphones an audio signal each, wherein the audio signals are digitized and each of the audio signals represents an audio channel $CH_1, \ldots, CH_4$. The first network output unit $Lim_{Ch}$ is adapted for generating for each of the audio channels $CH_1, \ldots, CH_4$ a network signal corresponding to a network channel $Ch_1, \ldots, Ch_4$ for output to a network. Further, the multi-channel microphone receiver MCR comprises a configuration unit CFG adapted for receiving configuration data Ctr, storing the received configuration data and providing the received and/or stored configuration data to one or more other units of the multi-channel microphone receiver, a mixer MX adapted for mixing the audio signals of at least two of the wireless microphones according to the configuration data Ctr, wherein at least one mixed audio signal $CH_{Mx}$ is generated, a second network output unit $DG_{Mx}$, $Lim_{MD}$ adapted for generating from the mixed audio signal $CH_{Mx}$ a network signal for being output to the network, wherein the network signal generated from the mixed audio signal corresponds to a further network channel $DO_{Mx}$, and an audio output unit DAC adapted for converting the mixed audio signal $CH_{Mx}$ into an analog signal $AO_{Mx}$ and further adapted for providing the obtained analog signal to an audio playback system.

It is clear that various features and embodiments as described above may be combined as appropriate.

The invention is particularly advantageous for extensive audio systems in larger buildings or areas, for example in conference centers, in lecture hall buildings of universities or for campus networks covering multiple buildings.

The invention claimed is:

1. A multi-channel receiving system comprising a playback system in at least a first room, at least two wireless microphones in at least a first or second room adapted for transmitting a radio signal, —at least one wireless receiver in the at least one first or second room for wirelessly receiving radio signals from—the at least two wireless microphones, —a network coupled between the playback system and the at least one wireless receiver adapted for providing audio signals from the at least one wireless receiver to the playback system, —a network controller adapted for providing configuration data, —said at least one wireless receiver comprises: an audio signal extraction processor adapted for extracting from the radio signals received from the two or more wireless microphones an audio signal each, wherein the audio signals are digitized and each of the audio signals represents an audio channel; and ○a first network output adapted for generating for each of the audio channels a network signal corresponding to a network channel for output to a network; ○a configuration processor adapted for receiving configuration data from the network controller, storing the received configuration data and providing the received or stored configuration data to one or more other processors of the multi-channel receiving system; a mixer adapted for mixing the audio signals of at least two of the wireless microphones according to the configuration data, wherein at least one mixed audio signal is generated; ○a second network output adapted for generating from the mixed audio signal a network signal for being output to the network, wherein the network signal generated from the mixed audio signal corresponds to a further network channel; and ○an audio output adapted for converting the mixed audio signal into an analog signal and further adapted for providing the obtained analog signal to the audio playback system.

2. The multi-channel receiving system according to claim 1, wherein the configuration data are received via the network.

3. The multi-channel receiving system according to claim 1, wherein the network is a Dante network.

4. The multi-channel receiving system according to claim 1, wherein the configuration data are received via a first network connection and wherein power is supplied to the multi-channel microphone receiver also via the first network connection, and wherein both the individual network signals of the audio channels and the network signal generated from the mixed audio signal are output via the first network connection.

5. The multi-channel receiving system according to claim 1, wherein the configuration data are received via a first network connection and wherein power is supplied to the multi-channel microphone receiver also via the first network connection, and wherein the first network output and the second network output may be configured by means of the configuration data such that the single network signals of the audio channels and the network signal generated from the mixed audio signal are output via a separate second network connection.

6. The multi-channel receiving system according to claim 1, wherein a gain or volume may be adjusted by means of the configuration data separately for each of the audio channels and for the audio channel generated from the mixed audio signal.

7. The multi-channel receiving system according to claim 1, wherein the mixer is a first mixer adapted for mixing the audio signals of at least two of the wireless microphones according to first configuration data, the multi-channel microphone receiver further comprising a second mixer adapted for mixing the audio signals of at least two of the wireless microphones according to second configuration data, wherein the first mixer generates a first mixed audio signal from which the digital mixed audio signal is generated, and wherein the second mixer generates a second mixed audio signal from which the analog mixed audio signal is generated.

8. The multi-channel receiving system according to claim 1, wherein the first network output comprises for each audio channel a limiter adapted for limiting an output level of the respective audio channel, and wherein the second network output processor comprises an adjustable gain and a further limiter adapted for limiting an output level of the mixed audio signal.

9. A multi-channel receiving method for a multi-channel receiving system comprising: a playback system in at least a first room, at least two wireless microphones in at least a first or second room, at least one wireless receiver in the at least one first or second room for wirelessly receiving radio signals from the at least two wireless microphones, a network coupled between the playback system and the at least one wireless receiver and a network controller adapted for providing configuration data, comprising the steps of: ○extracting from the radio signals received from the two or more wireless microphones an audio signal each, wherein the audio signals are digitized and each of the audio signals represents an audio channel; and ○generating for each of the audio channels a network signal corresponding to a network channel for output to a network; receiving configuration data from the network controller, or storing the received configuration data and providing the received or stored configuration data to the multi-channel receiving system; mixing the audio signals of at least two of the wireless microphones according to the configuration data, wherein at least one mixed audio signal is generated; ○generating from the mixed audio signal a network signal for being output to the network, wherein the network signal generated from the mixed audio signal corresponds to a further network channel; and ○converting the mixed audio signal into an analog signal and further adapted for providing the obtained analog signal to the audio playback system.

10. A multi-channel receiver comprising:

at least one wireless receiver for wirelessly receiving radio signals from two or more wireless microphones comprising:

an audio signal extraction processor adapted for extracting from the radio signals received from the two or more wireless microphones an audio signal each, wherein the audio signals are digitized and each of the audio signals represents an audio channel; and a first network output adapted for generating for each of the audio channels a network signal corresponding to a network channel for output to a network;

a configuration processor adapted for receiving configuration data, storing the received configuration data and providing the received or stored configuration data to one or more other processors of the multi-channel microphone receiver;

a mixer adapted for mixing the audio signals of at least two of the wireless microphones according to the configuration data, wherein at least one mixed audio signal is generated;

a second network output adapted for generating from the mixed audio signal a network signal for being output to the network, wherein the network signal generated from the mixed audio signal corresponds to a further network channel; and an audio output adapted for converting the mixed audio signal into an analog signal and further adapted for providing the obtained analog signal to an audio playback system.

* * * * *